US008109363B2

(12) United States Patent
Dubbert et al.

(10) Patent No.: US 8,109,363 B2
(45) Date of Patent: Feb. 7, 2012

(54) MODULAR RETAINING WALL FALL PROTECTION SYSTEM

(76) Inventors: Patrick C. Dubbert, Jefferson City, MO (US); Michael Best, St. Charles, MO (US); Wade Schmidt, St. Charles, MO (US); Scott Rozier, O'Fallon, MO (US)

( * ) Notice: Subject to any disclaimer, the term of this patent is extended or adjusted under 35 U.S.C. 154(b) by 2343 days.

(21) Appl. No.: 10/826,782

(22) Filed: Apr. 16, 2004

(65) Prior Publication Data

US 2004/0211153 A1 Oct. 28, 2004

Related U.S. Application Data

(60) Provisional application No. 60/465,954, filed on Apr. 28, 2003.

(51) Int. Cl.
*E04G 5/00* (2006.01)

(52) U.S. Cl. ..... 182/82; 52/127.2

(58) Field of Classification Search ..... 182/82, 182/113, 229; 52/127.2
See application file for complete search history.

(56) References Cited

U.S. PATENT DOCUMENTS

| | | | | |
|---|---|---|---|---|
| 2,249,941 | A * | 7/1941 | Burton | 104/125 |
| 3,690,613 | A * | 9/1972 | Shoemaker | 249/40 |
| 3,712,576 | A * | 1/1973 | Dagiel | 249/192 |
| 3,741,516 | A * | 6/1973 | Rugger | 249/216 |
| 3,817,347 | A | 6/1974 | Spencer | |
| 4,600,179 | A | 7/1986 | Willetts | |
| 4,649,679 | A | 3/1987 | Arens | |
| 4,850,453 | A * | 7/1989 | St-Germain | 182/229 |
| 4,867,420 | A | 9/1989 | Anderson | |
| 5,163,261 | A | 11/1992 | O'Neill | |
| 6,062,341 | A * | 5/2000 | Frank et al. | 182/113 |
| 6,131,698 | A * | 10/2000 | Reyland | 182/82 |
| 6,464,037 | B2 | 10/2002 | Baldas et al. | |
| 6,539,677 | B1 * | 4/2003 | Lanka | 52/127.2 |
| 6,983,824 | B1 * | 1/2006 | Dandurand | 182/82 |
| 2002/0041796 | A1 | 4/2002 | Greenberg | |

* cited by examiner

*Primary Examiner* — Alvin Chin Shue
(74) *Attorney, Agent, or Firm* — Polster Lieder Woodruff & Lucchesi, L.C.

(57) ABSTRACT

The present disclosure provides a retaining wall fall protection system having a plurality of base plates. It further includes a plurality of uprights pivotally attached to the base plates and a cross-brace attached to adjacent uprights at opposite ends of the cross-brace. A plurality of guardrails are provided and attached to guardrail adjustment brackets. The guardrail brackets are removably attachable to the uprights at various positions along the length of the uprights. Finally, there is provided an attachment assembly which secures the uprights in position adjacent the retaining wall. The attachment assembly comprises an attachment strap which is mounted to the upright and sized to extend through the retaining wall. A retainer on the opposite side of the wall engages a distal end of the attachment strap to secure the scaffolding to the retaining wall under construction.

3 Claims, 11 Drawing Sheets

MODULAR RETAINING WALL FALL PROTECTION SYSTEM

CROSS-REFERENCE TO RELATED APPLICATIONS

This application claims priority to Provisional Application No. 60/465,954 which was filed Apr. 28, 2003, which is entitled "Modular Retaining Wall Fall Protection System", and which is incorporated herein by reference.

STATEMENT REGARDING FEDERALLY SPONSORED RESEARCH OR DEVELOPMENT

Not Applicable.

BACKGROUND OF THE INVENTION

The Occupational Safety and Health Administration requires that retaining walls being built over a specified height must use a retaining wall fall protection system to prevent those building the wall from being injured by a fall. However, no retaining wall fall protection systems exist which allow the retaining wall builder to quickly assemble and disassemble a protection system and be able to quickly change the configuration of the protection system to protect workers as the wall is being built. As such, there is a need for a retaining wall fall protection system of the present invention.

BRIEF SUMMARY OF THE INVENTION

The present invention comprises a retaining wall fall protection system comprising a plurality of base plates held in position by a retaining wall. It further includes a plurality of uprights pivotally attached to the base plates and a cross-brace attached to adjacent uprights at opposite ends of the cross-brace. A plurality of guardrails are provided and attached to guardrail adjustment brackets. The guardrail brackets are removably attachable to the uprights at various positions along the length of the uprights. Finally, there is provided an attachment assembly which secures the uprights in position adjacent the retaining wall.

The attachment assembly comprises an attachment strap which is adapted at one end to be connected to the scaffolding upright. Preferably, a standoff bracket is provided to which the attachment strap is connected. The attachment strap is adapted at its opposite end to be connected to the retaining wall being constructed. The attachment strap can be connected directly to the wall, for example, to an alignment key on the blocks from which the wall is made.

Alternatively, and preferably, the attachment strap extends through the wall. A retainer on the opposite side of the wall engages a distal end of the attachment strap to secure the scaffolding to the retaining wall under construction. The strap can be in the form of a rod which is threaded or grooved at its distal end. In this case, the retainer includes a threaded portion or acts in a ratcheting manner to engage the strap. In a preferred alternative, the retaining strap includes a slot at is distal end and the retainer includes a wedge. The strap passes through the retainer, and the wedge is inserted in the slot, such that one edge of the wedge engages a far surface of the strap slot and an opposite edge of the wedge engages the retainer.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

While the invention is susceptible of embodiment in many different forms, there is described in detail preferred embodiments of the invention. It is to be understood that the present disclosure is to be considered only as an example of the principles of the invention. This disclosure is not intended to limit the broad aspect of the invention to the illustrated embodiments. The scope of protection should only be limited by the claims.

Figure 2:
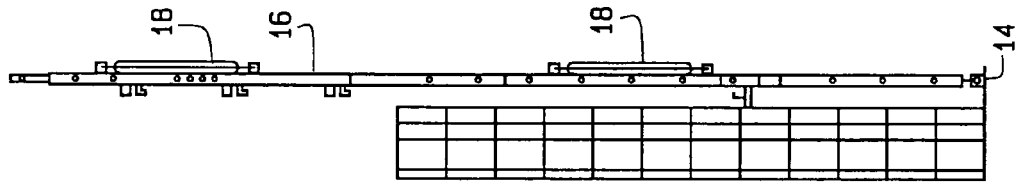
FIG. 2 is side view of an assembled retaining wall fall protection system according to an embodiment of the present invention used with a vertical retaining wall.
Figure 1:
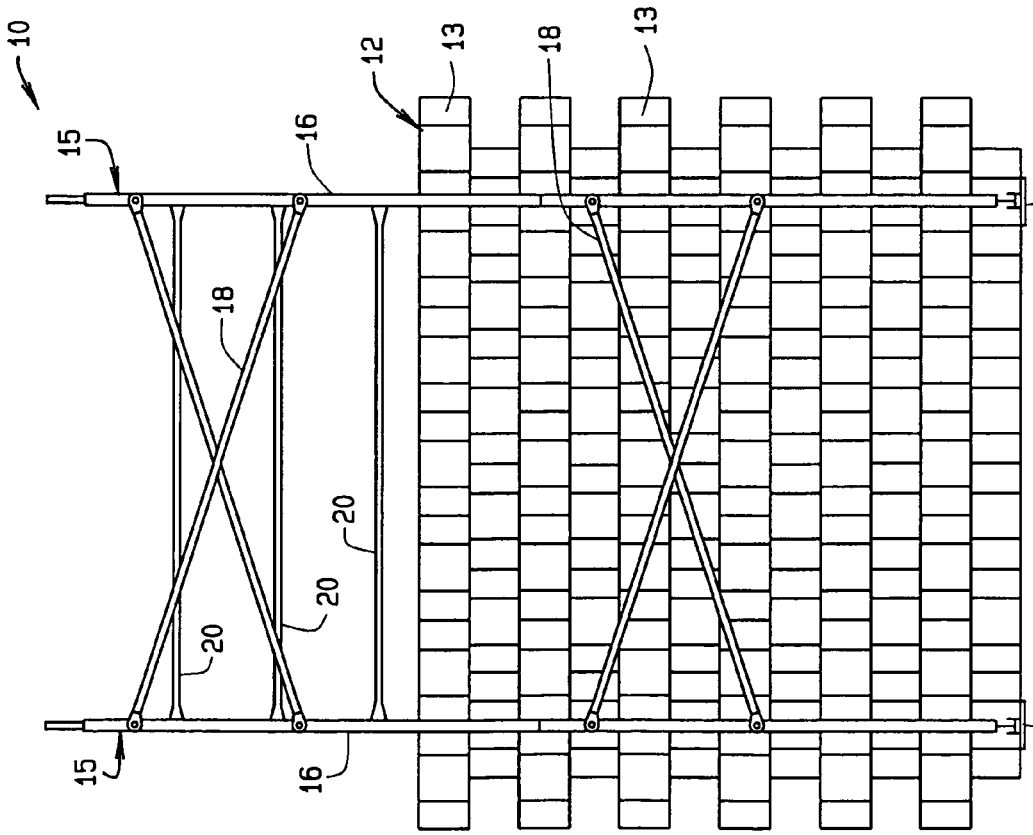
FIG. 1 is plan view of an assembled retaining wall fall protection system according to an embodiment of the present invention.

Referring to FIGS. 1 and 2, the present invention comprises a fall protection system 10 for protecting workers while they are building a retaining wall 12 made from blocks 13. As will be apparent, the fall protection system 10 comprises a scaffolding system which, using brackets and attachment assemblies as described below, is secured to the wall 12. Upon completion of the wall 12, the scaffolding is removed from the wall.

Figure 4A:
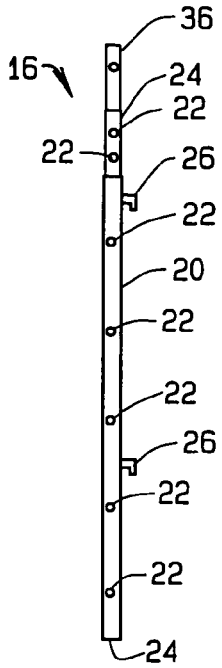
FIGS. 4A and 4B are front and side elevational views of an upright for use with a retaining wall fall protection system according to an embodiment of the present invention.
Figure 4B:
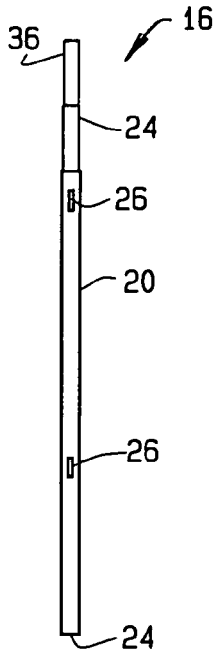
Figure 5A:
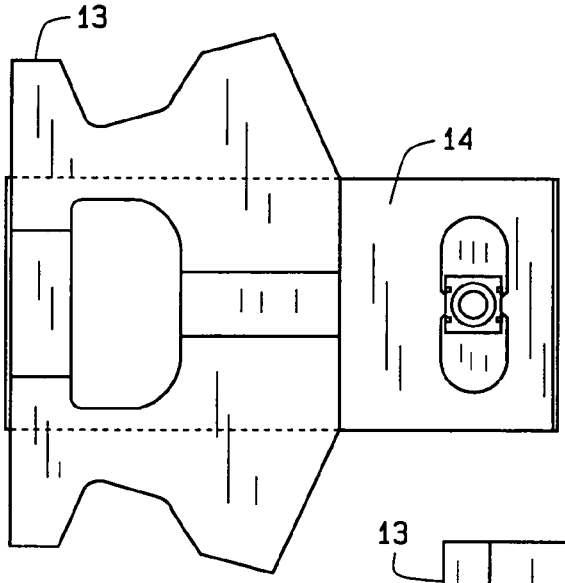
FIGS. 5A and 5B are a top and side plan views, respectively, of a base plate for use with a retaining wall fall protection system according to an embodiment of the present invention having a retaining wall block placed thereon.
Figure 5B:
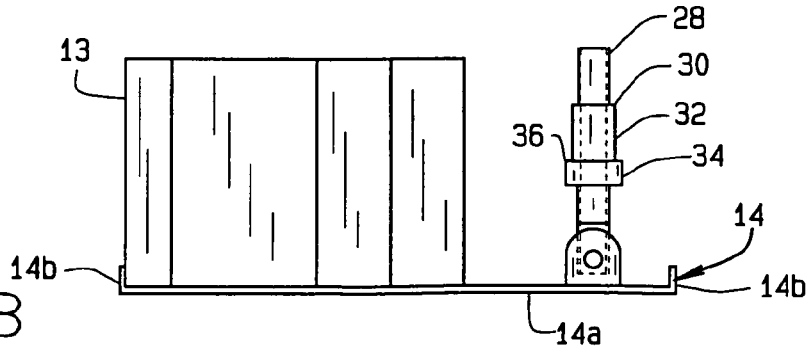

The system 10 generally comprises base plates 14 each having an upright assembly 15 made from uprights 16 attached to the base plates 14. The adjacent uprights 16 are connected by cross-braces 18 and guardrails 20 which extend between the uprights 16. Referring to FIGS. 4A and 4B, each upright 16 comprises a tube having several holes 22 formed therein. The upright 16 further comprises toggle studs 26.

Referring to FIGS. 1, 2, 5A and 5B, base plates 14 are placed upon the ground and the retaining wall 12 is built upon a portion of the base plate 14 thus securing it in place. As seen, the base plate 14 has a bottom surface 14*a* and front and back lips 14*b* and 14*c*. The retaining wall block 13 rests against the back lip 14*b*. The base plate 14 has a length greater than the depth of the block and extends forwardly of the block. Hence, the front lip 14*b* is forward of the front surface of the wall blocks 13. The base plate 14 further includes a leveling screw 28 pivotally mounted to the base plate 14 to pivot in a plane generally perpendicular to the base plate 14. A leveling nut 30 is threadingly mounted on the screw 28. The leveling nut 30 has first and second diameters 32, 34. The first diameter 32 is slightly smaller than the inside diameter of an end 24 of the upright 16 such that an upright 16 may be placed over the first diameter 32. The second diameter 34 is larger than an outside diameter of the upright 16 such that when the upright 16 is placed over the first diameter 32, it rests upon a shoulder 36 formed by the interface of the first diameter 32 and the second diameter 34. In this manner, the height of the upright 16 may be adjusted with respect to other uprights 16 by turning the leveling nut 30 with respect to the leveling screw 28 and the base plate 14.

Figure 6A:
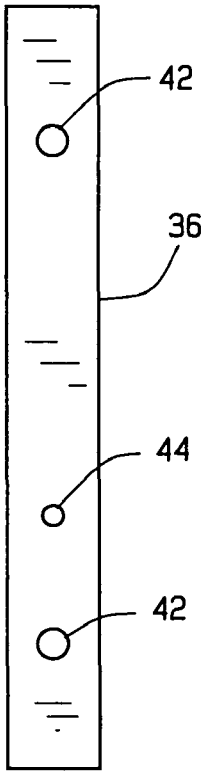
FIGS. 6A and 6B are plan views of a coupling tube for use with a retaining wall fall protection system according to an embodiment of the present invention.
Figure 6B:
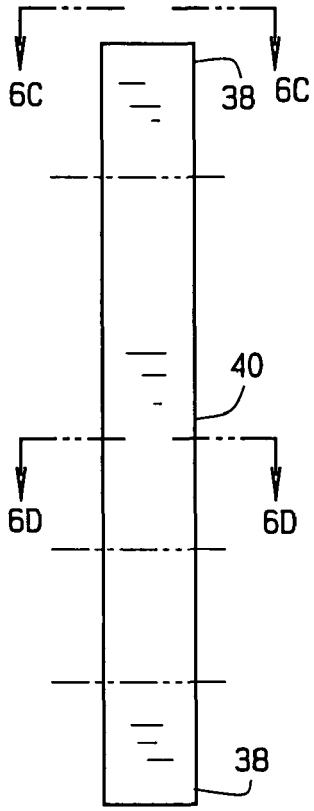
Figure 6C:
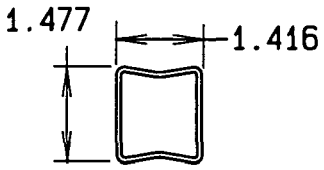
FIGS. 6C and 6D are section views of the coupling tube taken along lines C-C and D-D, respectively, of FIG. 6B.
Figure 6D:
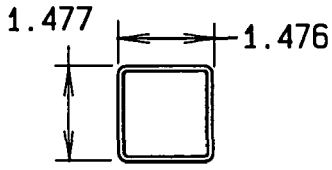

Furthermore, referring to FIGS. 4A-B and 6A-D, multiple uprights 16 may be attached at their ends to build longer upright assemblies 15 by placing a coupling tube 36 in the ends 24 of two uprights 16. The coupling tubes 36 comprise square tube that has been compressed at its ends 38 such that the tube is narrower in one dimension at its ends than it is at its center 40. For example, in FIG. 6C, a coupling tube 36 originally having a outside dimensions of 1.477 inches square, is compressed in one direction at its ends such that one outside dimension is reduced to 1.416 inches. However, the center 40 of the coupling tube 36 is compressed very little, if any, as shown in FIG. 6D. In this manner, coupling tubes 36 may be easily inserted into the ends 24 of the uprights 16 initially and provide an increasingly tighter fit as they are inserted farther in to the upright 16. The coupling tube 36 further includes a pair of coupling pin holes 42 and a spring pin hole 44. The coupling pin holes 44 align with holes 22 of the uprights such that gravity pins 46 (FIGS. 7A-C) may be inserted through the coupling tube 36 and the upright 16 to prevent them from becoming unattached. The spring pin hole 44 also aligns with a hole 22 of the upright 16 and has a spring loaded pin (not shown) disposed within the hole 44.

Figure 7A:
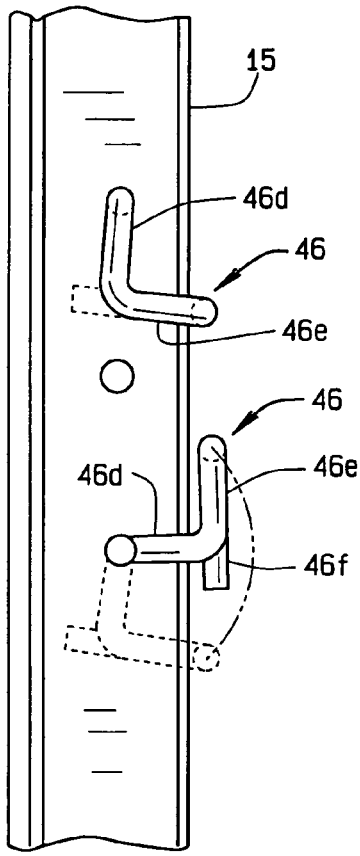
FIGS. 7A and 7B are front and side views of a gravity pin in use with an upright according to an embodiment of the present invention.
Figure 7B:
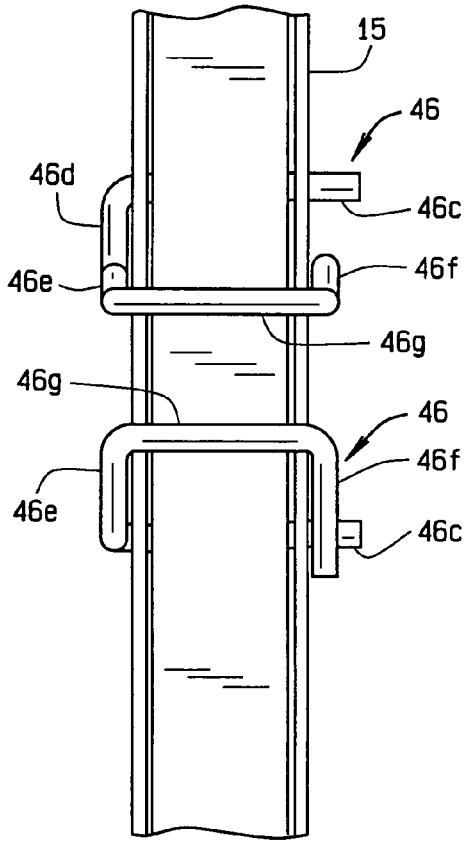
Figure 7C:
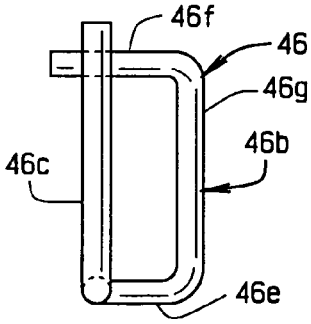
FIG. 7C-F are top plan, side elevational, front elevational and perspective views, respectively of the gravity pin.
Figure 7D:
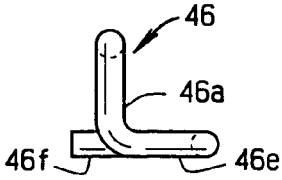
Figure 7E:
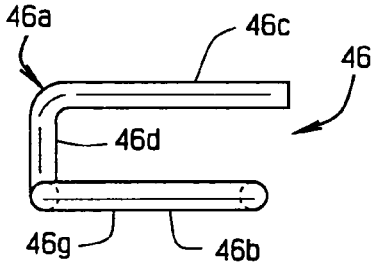
Figure 7F:
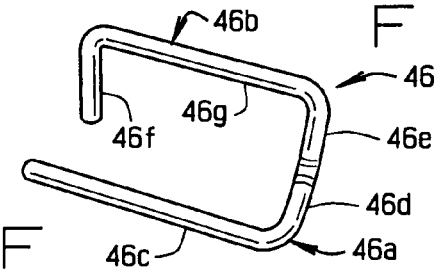

Referring to FIGS. 7A-C, the gravity pin 46 comprises a rod bent into the configuration shown. The pin includes an L-shaped mounting section 46*a* having a portion 46*c* which extends through the holes 22 and 42 of the upright 16 and coupling tube 36, respectively, and a short leg 46*d* which extends generally perpendicularly from one end of the portion 46*c*. A U-shaped section 46*b* extends from an end of the short leg 46*d* and is in a plane perpendicular to the plane of the mounting section 46*a*. The U-shaped section 46*b* comprises a pair of short legs 46*e,f* joined by a section 46*g*. The U-shaped section leg 46*e* extends the mounting portion leg 46*d*. As best seen in FIG. 7C, the leg 46*f* is parallel to, and longer than, the leg 46*e*. Hence, the leg 46*f* crosses the plane of the mounting section 46*a*. The pin 46 is inserted into the upright 16 in the position shown in the bottom of FIGS. 7A and 7B and is allowed to drop by the force of gravity to the position shown in the top of FIGS. 7A and 7B. In the locked position, the U-shaped lock section extends around three sides of the upright 16 to prevent the pin 46 from being removed from the upright 16 without lifting the pin back to the "insert" position. As such, the pin 46 cannot accidentally be removed from the upright 16 by vibration or other accidental means.

Figure 8:
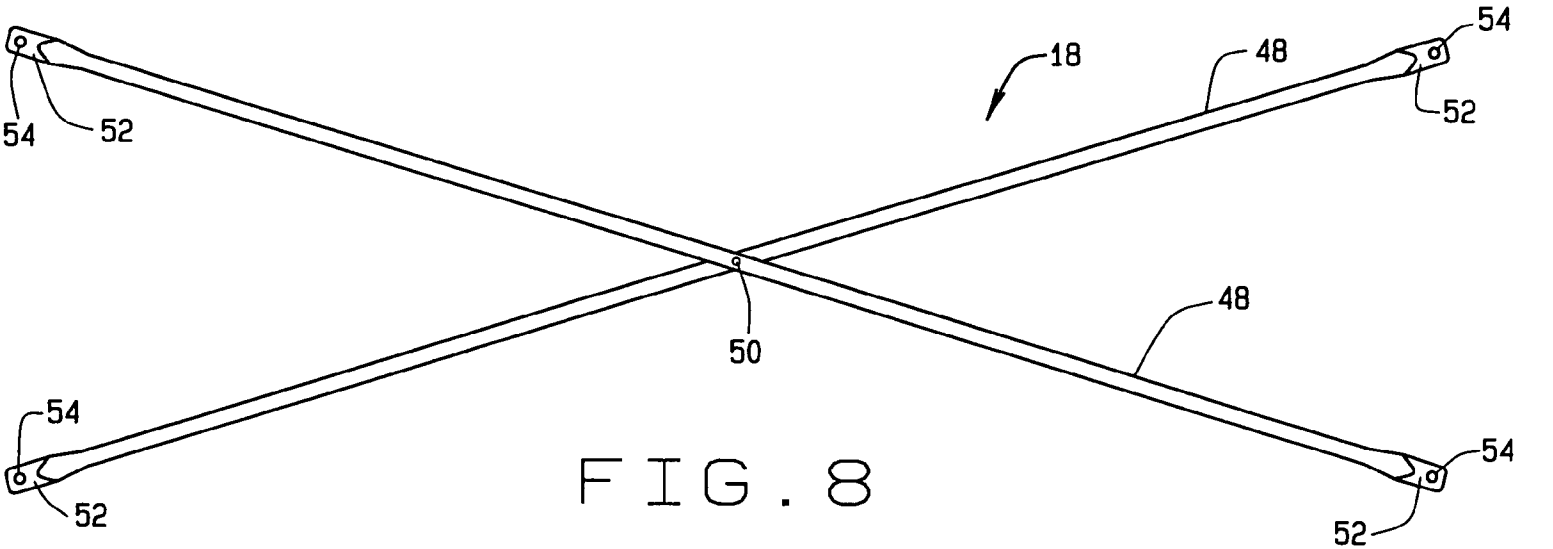
FIG. 8 is a plan view of a cross-brace for use with a retaining wall fall protection system according to an embodiment of the present invention.

A cross-brace 18 shown in FIG. 8 comprises two lengths of rod 48 joined at their centers by a pin 50. The rods 48 have flattened end portions 52 having a hole 54 therein. The cross-braces 18 are attached to the uprights 16 by placing the toggle studs 26 of the uprights 16 through the holes 54 of the cross-brace 18.

Figure 9:
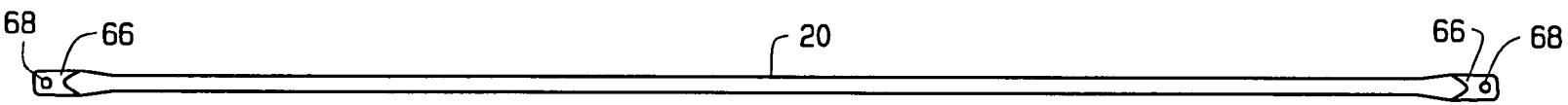
FIG. 9 is a plan view of an A-type guardrail for use with a retaining wall fall protection system according to an embodiment of the present invention.
Figure 10:
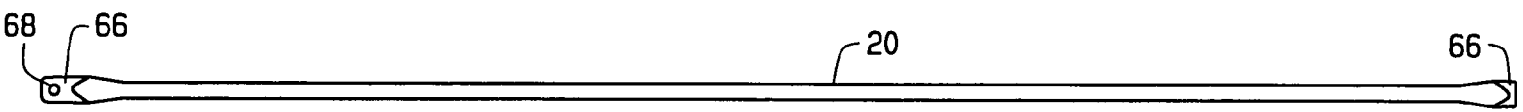
FIG. 10 is a plan view of a B-type guardrail for use with a retaining wall fall protection system according to an embodiment of the present invention.

Referring to FIGS. 9, 10, 11A and 11B, guardrails 20 are attached to the uprights 16 by means of guardrail brackets 56. FIG. 9 illustrates guardrails 20 of the A-type and FIG. 10 illustrates guardrails 20 of the B-type. B-type guardrails 20 comprise a tube having both ends 66 flattened and a hole 68 in one of the ends 66. A-type guardrails comprise a tube having both ends 66 flattened and a hole 68 in each end 66. Both the A- and B-type guardrails include holes at their centers through which the pin 50 can extend to pivotally connect two guardrails together.

Figure 11A:
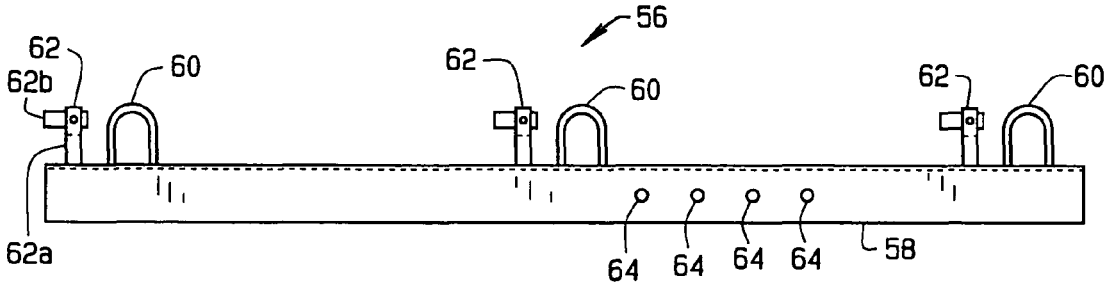
FIGS. 11A and 11B are front and right side plan views of a guardrail bracket for use with a retaining wall fall protection system according to an embodiment of the present invention.
Figure 11B:
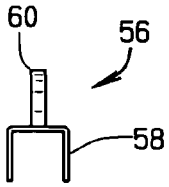

Turning to FIGS. 11A and 11B, the guardrail brackets 56 comprise a C-shaped channel 58 having a plurality of U-hooks 60 and toggle studs 62 attached thereto and extending from a front face of the channel member. Holes 64 are formed in the sidewall of the channel member. The toggle studs 62 each include an arm 62*a* and a finger 62*b* pivotally mounted to the end of the arm. The stud arm 62*a* and finger 62*b* are sized to allow the holes 54 of the cross-brace rods 48 and the holes 68 of the guardrail rods 20 to pass thereover. Hence, to place the cross-braces or the guardrails on the brackets 56, the toggle stud is positioned so that the toggle stud arm and finger are aligned. The cross-brace rods or guard rail rods are then slid over the toggle stud, and, with the rod opening 54 or 68 positioned on the toggle stud arm, the toggle stud finger is rotated relative to the arm to prevent the rod from coming off the arm.

Figure 12A:
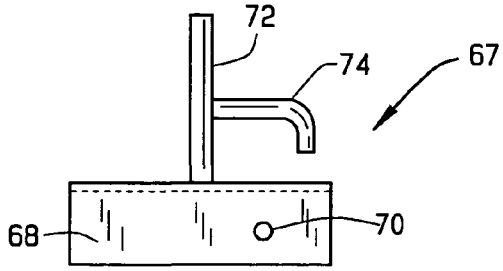
FIGS. 12A and 12B are front and right side plan views of a standoff bracket for use with a retaining wall fall protection system according to an embodiment of the present invention.
Figure 12B:
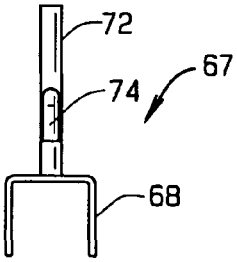

FIGS. 12A-B show a standoff bracket 67 according an embodiment of the present invention. The standoff bracket 67 comprises a C-shaped channel member 68 having a hole 70 in its sidewall and a standoff 72 extending from its front face. The standoff 72 further comprises a wall attachment dowel 74. The channel member is sized and shaped to be received on the scaffolding uprights 16, and the hole 70 is sized and shaped to be aligned with the openings in the uprights such that a gravity pin 46 can pass through the bracket 67 and the upright 16, as seen in FIG. 12C to maintain the bracket 67 on the upright.

Figure 12C:
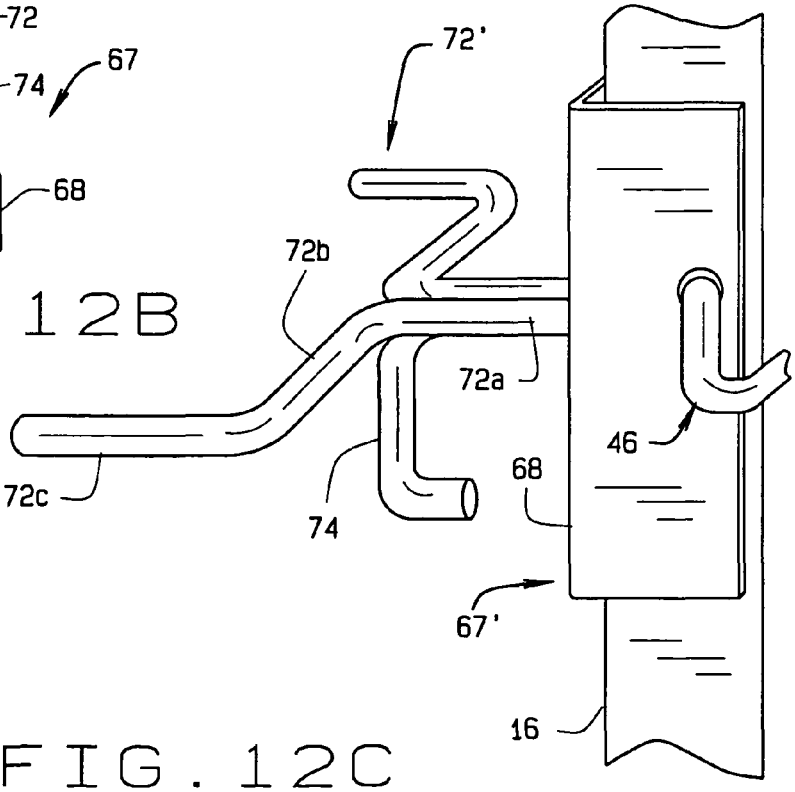
FIG. 12C is a perspective view of the standoff bracket mounted to a scaffolding upright.

An alternative standoff bracket 67' is shown in FIG. 12C. The bracket 67' includes a channel member 68 identical to the channel member 68 of FIGS. 12A,B. The standoff member 72' however, is slightly different. Rather than being a straight rod, as is the standoff member 72, the standoff member 72' comprises a pair of members comprising a first portion 72*a* which extends generally perpendicularly from the front face of the channel member 68. The first portions 72*a* of the two members are adjacent and parallel to each other. A second portion 72*b* extends generally perpendicular to the first member 72*a* in a generally horizontal plane. The second portions 72*b* of the two member extend away from each other. Lastly, third portions 72*c* extend rearwardly from the second portions to be generally parallel to each other and to the first potions 72*a*. Hence, the stand off is generally "ψ" in plan view. The attachment dowel 74 extends generally perpendicularly from the stand off first portion 72*a* to be generally parallel to the front face of the channel member 68. Although the bracket 67' is shown to be connected to the upright 16 with the attachment dowel member extending downwardly, the bracket 67' can be connected to the upright with the attachment dowel 74 extending upwardly.

Figure 13A:
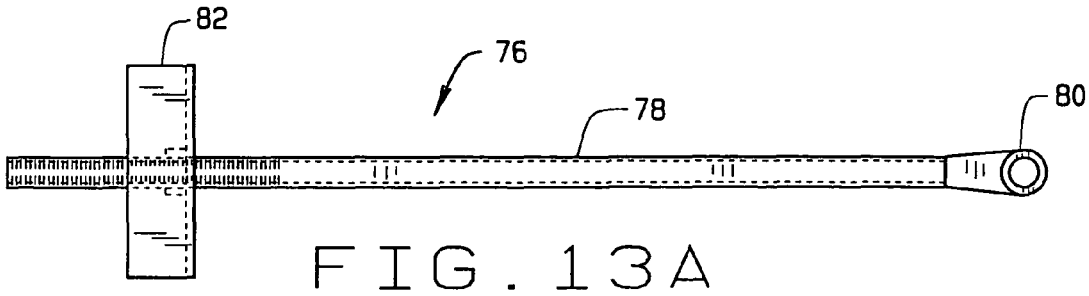
FIGS. 13A and 13B are front and side plan views of a wall attachment assembly for securing scaffolding uprights to the retaining wall being constructed, the attachment assembly comprising a connecting member and a retainer.
Figure 13B:
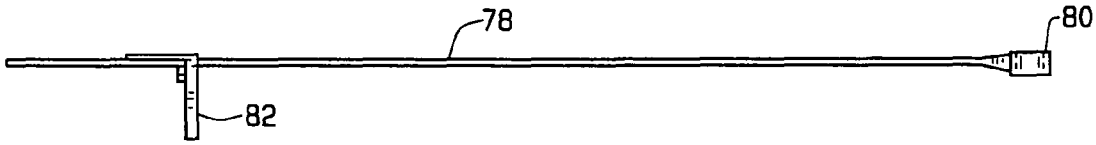

FIGS. 13A-B show a wall attachment assembly 76. The wall attachment assembly 76 comprises an attachment strap in the form of a threaded rod 78 having an eye 80 at one end. Threaded onto the threaded rod 78 is a retainer 82. The eye 80 is sized to be able to fit over the attachment dowel 74 of the bracket 67. Alternatively, the rod 78 could be grooved, rather than threaded, and the retainer 82 could be adapted to engage the grooves to provide a ratcheting type engagement between the rod 78 and the retainer 82.

Figure 14:
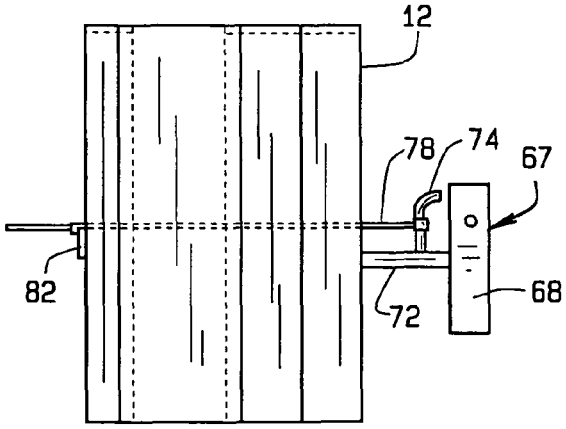
FIG. 14 is a side view of a wall attachment assembly and a standoff bracket in position relative to a retaining wall fall to secure scaffolding to the retaining wall.

In order to assemble the retaining wall fall protection system 10 of the present invention, the user begins by assembling the wall 12 on top of the base plates 14. As the wall 12 increases in height, the user adds uprights 16 by first placing uprights upon the leveling nuts 30. Cross-braces 18 are attached to the toggle studs 26 of the uprights 16, as noted above, to provide stability to the uprights 16. Referring to FIG. 14, the threaded rod 78 of the wall attachment assembly 76 is fed through the wall 12 by pulling the rod 78 through a preexisting passage between the wall blocks 13. The retainer 82, which is too large to feed through the wall 12, is threaded onto the rod 78. The wall attachment rod 78 is attached to the standoff bracket 67 by inserting the dowel 74 through the eye 80. The retainer 82 is threaded onto the rod 76 until the standoff 72 makes contact with the wall 12. The standoff brackets 67 are attached to the uprights 16 with gravity pins 46 to mount the standoff brackets to the uprights the mounting section 46*a* of the gravity pin 46 passes through the holes 70 of the standoff bracket 67 of the upright 16. In this manner, the fall protection system is supported by the wall 12 and maintained a predetermined distance from the wall.

Next, guardrail brackets 56 are attached to the uprights 16 with gravity pins 46. This is accomplished by placing the C-shaped channel 58 of the guardrail bracket 56 over the upright 16 and aligning one of the holes 64 with holes 22 in the upright 16. The gravity pin 46 is placed through these aligned pairs of holes 22, 64 and allowed to drop to the locked position. Furthermore, the A-type guardrails 20 are attached to the guard rail brackets 56 by inserting the guardrail end 66 without the hole 68 though the U-hooks 60 of the guardrail bracket 20 and attaching the guard rail end 66 with the hole 68 over the toggle studs 62 of the guardrail bracket 56 of the adjacent upright 16. B-type guardrails 20 may be installed by place the holes 68 of each end 66 over toggle studs 62 of the guardrail brackets 56. In this manner, the guard rails form a fence to protect workers from falling over the edge of the wall 12.

As the wall 12 increases in height, the guardrails 20 must necessarily be raised and the uprights 16 lengthened. To lengthen the uprights 16, coupling tubes 36 are inserted into the top end of the existing uprights 16 and a gravity pin is placed through aligned holes 22, 42 of the upright 16 and the coupling tube 36. Another upright 16 is then placed over an exposed portion of the coupling tube 36 and another gravity pin placed through holes 22, 42 of the new upright 16 and the coupling tube 36. The guardrail brackets 56 are then removed from the uprights 16 and reattached at a higher position upon the newly added uprights 16. Alternatively, the guardrail brackets 56 can be left in place and additional guardrail brackets 56 can be added as the wall increases in height. Additional wall attachment assemblies 76 are mounted to the uprights 16 as needed to ensure that the uprights are secured against the wall 12.

Figure 3:
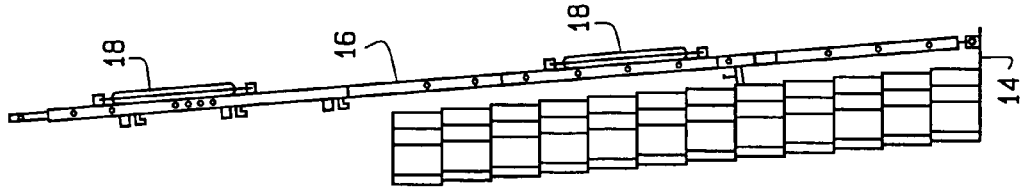
FIG. 3 is side view of an assembled retaining wall fall protection system according to an embodiment of the present invention used with a sloped retaining wall.

As can be seen from FIG. 3, the retaining wall fall protection system can be used with vertical retaining walls 12 as in FIG. 2 or with sloped retaining walls 12 as in FIG. 3 by virtue of the pivoting connection of the leveling screw 28 to the base plate 14.

When the wall is completed the protection system 10 can be disassembled and removed from the wall 12. All that will remain are the base plates 14 and the retainers 82 located between the back of the wall and the earth.

An alternative wall attachment assembly 100 is shown in FIGS. 17-19D. The attachment assembly 100 comprises an attachment strap 102 having an eyelet 104 at one end and a slot 106 at the opposite end. The eyelet 104 is sized to fit over the attachment dowel 74 of the bracket 67 or 67'. The strap 102 is preferably formed from a material so that it will be flexible. A preferred material is a plastic, such as nylon. The strap 102 has length sufficient to extend through the retaining wall 12 as seen in FIGS. 18A,B. The ends 102*a,b* of the strap 102, where the eyelet 104 and slot 106, respectively, are located, is thicker than the center section 102*c* of the strap.

Figure 19:
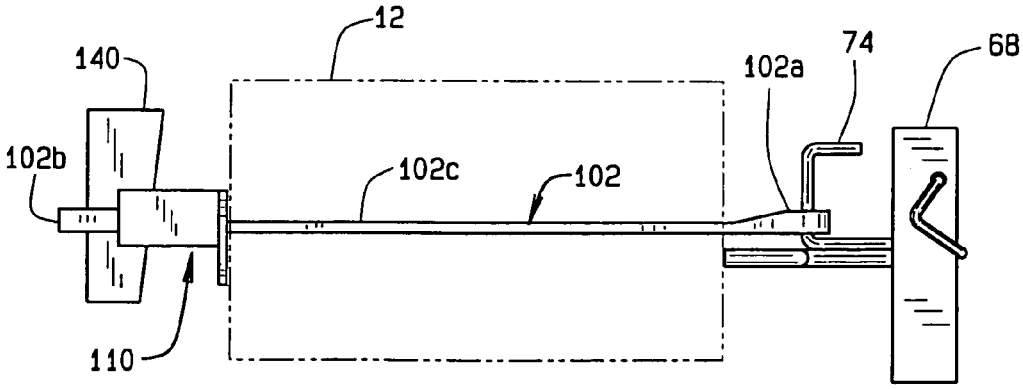
Figure 19A:
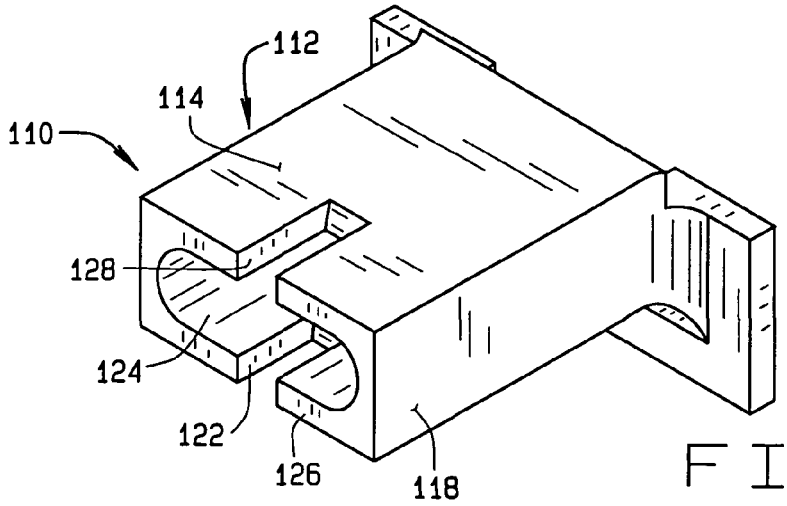
FIGS. 19A-C are rear perspective, top plan, and front elevational views of a retainer for use with the attachment assembly of FIG. 17.
Figure 19B:
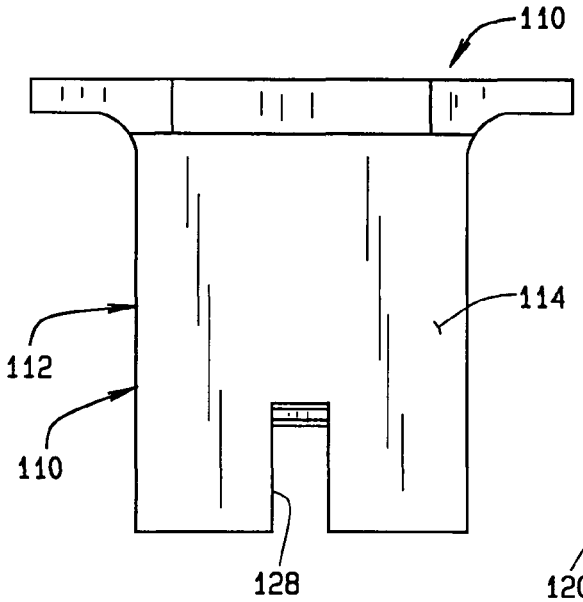
Figure 19C:
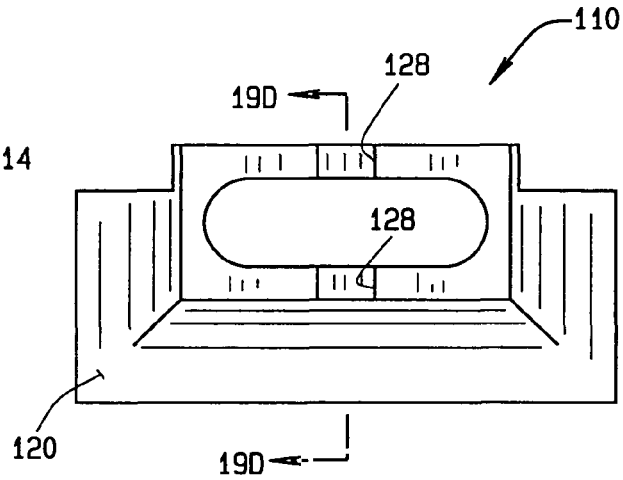
Figure 19D:
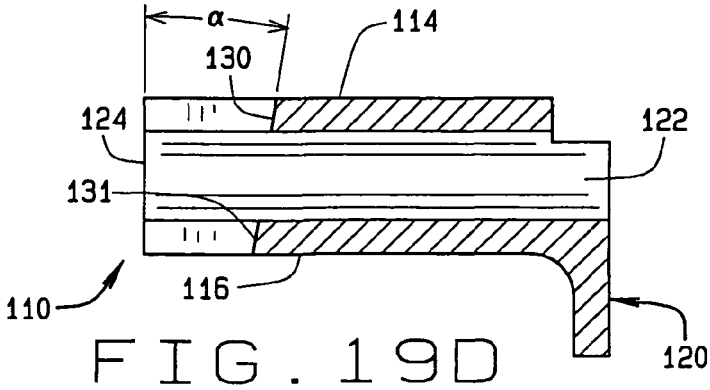
FIG. 19D is a cross-sectional view of the retainer taken along line 19D-19D of FIG. 19C.

The attachment assembly also includes a retainer 110 (FIGS. 19A-D) which is provided to be positioned on the back side of the retaining wall to receive the strap 102. The retainer 110 includes a body 112 having a top surface 114, bottom surface 116, and side surfaces 118. A front face 120 is formed at the front of the body 112. As seen, the front face 120 forms a flange which extends around three sides of the body 112. If desired, the front face 120 could have an area equal to the area defined by the front of the body (i.e. the face 120 would not define a flange). Alternatively, the front face 120 could form a flange on only two sides of the body or on all four sides of the body. The retainer includes an opening 122 in the front face 120 and an opening 124 on the back surface 126 of the body. The front and back openings 122 and 124 are sized to permit the strap 102 to pass through the retainer 110. As shown, the back opening is generally oval in shape, and the front opening is generally rectangular. If desired, both openings could be of the same size and shape. Lastly, the retainer includes slots 128 at the back of the top and bottom body surfaces 114 and 116. As seen in FIG. 19D, the back surfaces 130, 131 of the two slots form an angle □ relative to the back surface of the body. The angle □ is about 5°-10°, and preferably, about 8°. Also, as seen, slots 128 in the top and bottom surfaces are formed such that their respective back surfaces 130 and 131 are co-linear.

A wedge 140 is provided with the retainer. As best seen in FIG. 18B, the wedge 140 is generally trapezoidal in shape, and has two sloped side edges which angle away from each other, such that the top of the wedge is wider than the bottom of the wedge. Preferably, the slope of the wedge side edges corresponds substantially to the slope or angle $\alpha$ of the retainer body slot back walls 130, 131. The wedge 140 has a thickness such that it can be received in the slot 106 of the attachment strap 102. The wedge has a width at its top greater than the length of the strap slot 106 and a width at its bottom less than the length of the strap slot 106.

Figure 15:
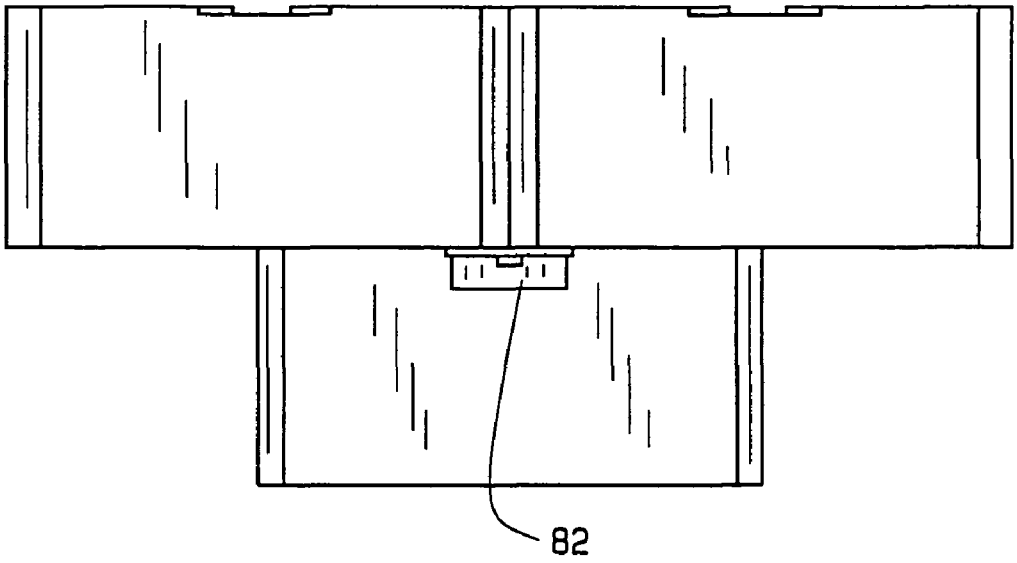
FIG. 15 is a back elevational view of a wall attachment assembly and a standoff bracket in use with a curved retaining wall.
Figure 16:
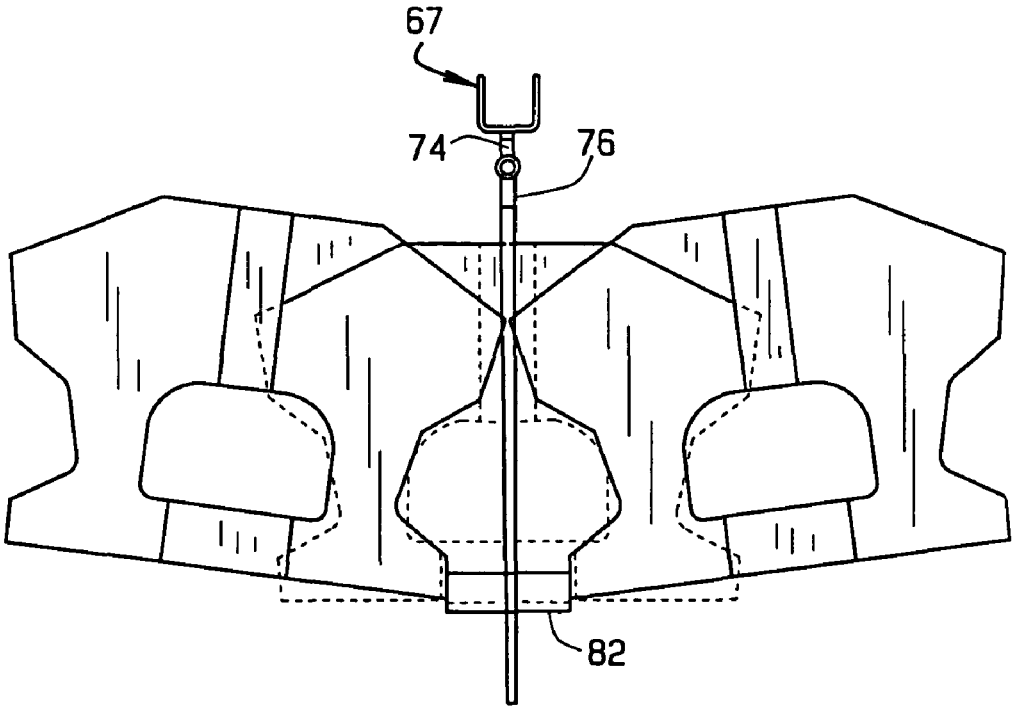
FIG. 16 is a top plan view of a wall attachment assembly and standoff bracket in use with a curved retaining wall.
Figure 17:
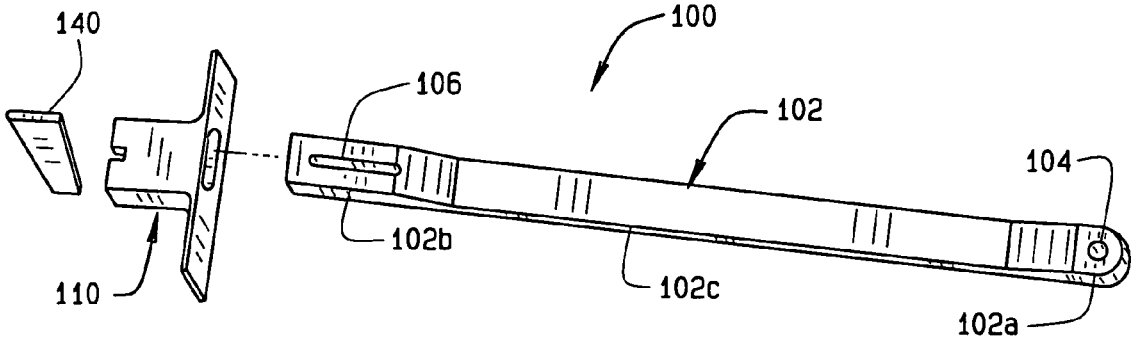
FIG. 17 is an exploded view of an alternative wall attachment assembly.
Figure 18:
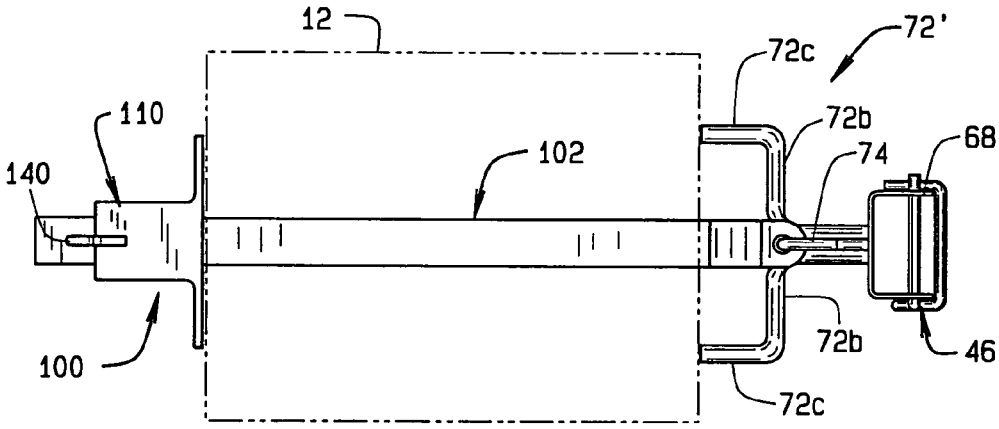
FIGS. 18 and 19 are top plan and side elevational views showing the wall attachment assembly of FIG. 17 mounted to a stand-off bracket and with a connecting strap extending through the retaining wall, the wall being shown in phantom.

To use the attachment assembly 100, the bracket 67 (or 67') is mounted to the scaffolding upright such that such that the attachment dowel 74 is positioned near the top of a row of blocks of the wall 12 under construction. The strap 102 is passed through the wall 12 as seen in FIGS. 14-16. The strap eyelet 104 is passed over the attachment dowel 74, as seen in FIGS. 18A,B, and the retainer 110 is slid over the end of the strap 102, and the front face 120 of the retainer is positioned against the back side of the wall. The strap and retainer are sized such that, when the retainer 110 is slid over the strap, a portion of the strap slot 106 extends beyond the back surface 130,131 of the slots 128 while a portion of the strap slot 106 is forward of the retainer body slots 130, 131. With the stand off 72 (72') against the retaining wall, as seen in FIG. 18A,B, the wedge 140 is inserted in the strap slot 106. As can be appreciated, one side edge of the wedge will engage the end of the strap slot while the other side edge of the wedge 140 will engage the walls 130, 131 of the retainer body slots 128. As the wedge 140 is driven into the slot, the wedge will urge the strap 102 and retainer 110 in opposite directions, such that that the retainer 110 and the bracket standoff 72 (72') will be pulled into tight contact with the retaining wall being built. As can be appreciated, the wedge 140 will be frictionally held in place in the strap slot 106 and the retainer body slot 128 and the retaining wall 12 will be tightly sandwiched between the retainer 110 and the bracket standoff 72 (72'). Hence, the scaffolding upright 116 will be held securely in place relative to the wall 12.

Figure 20:
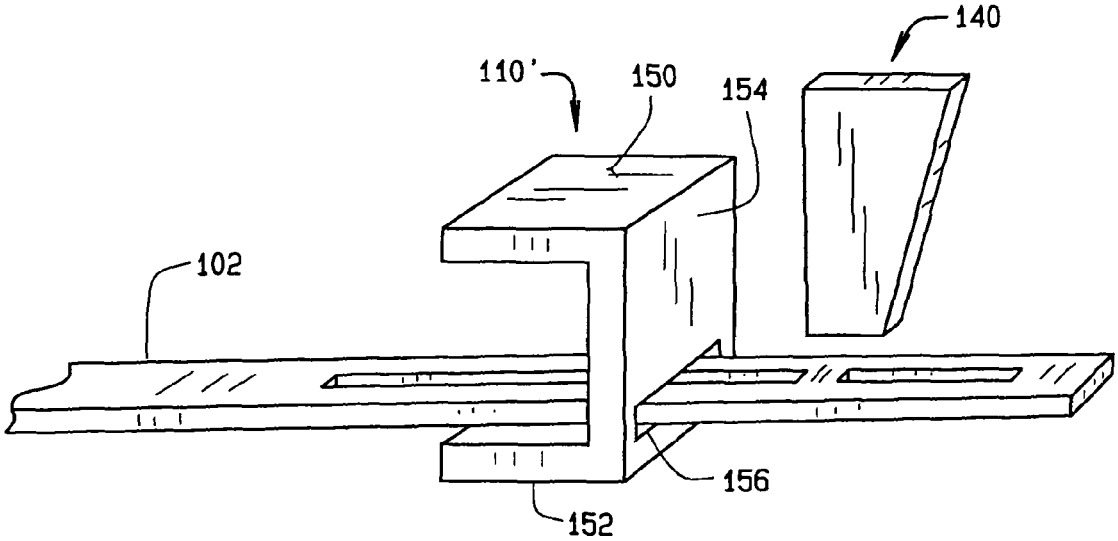
FIG. 20 is a perspective view of an another alternative attachment assembly for use with an open-walled system.
Figure 21:
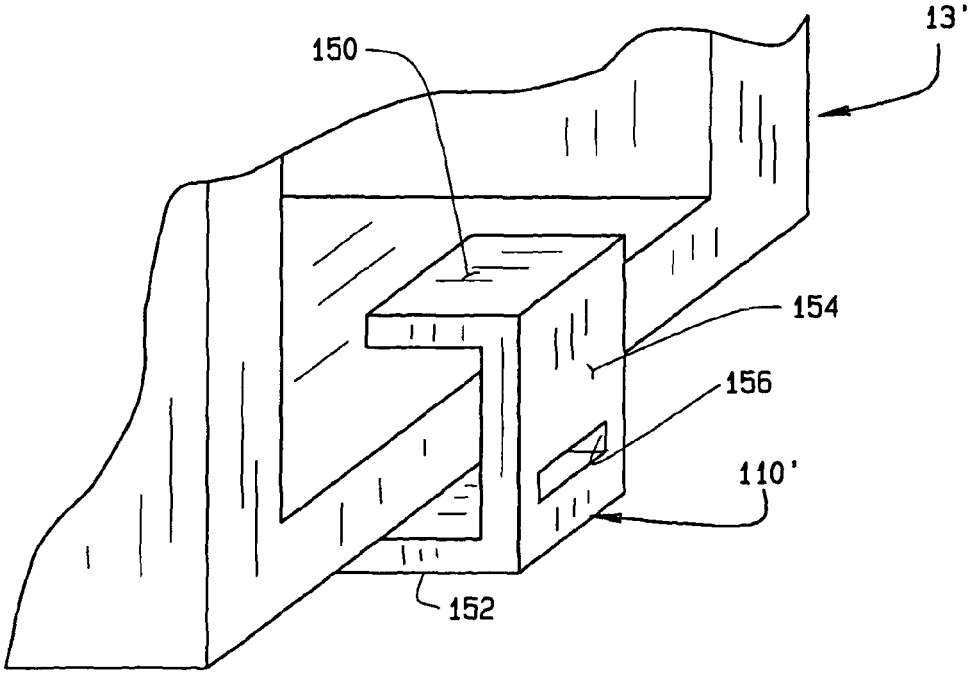
FIG. 21 is a perspective view showing the retainer of the attachment assembly of FIG. 20 mounted to a wall block.

The retainer 110 is designed for use with a closed wall system. An alternative retainer 110' (FIGS. 20-21) is provided to enable the attachment system 100 to be used with an open wall system. As is known, in a closed wall system, the front faces of the blocks are solid, to provide a solid or uninterrupted front surface to the wall. In an open wall system, on the other hand, the blocks 13' are open along their front and back faces, and may even be open along their top surfaces. Hence, blocks 13' can be in the form of a tube or can be generally U-shaped. As is known, an open wall system allows for vegetation to be planted in the openings on the wall. The retainer 110' is in the form of a C-channel having top and bottom surfaces 150 and 152 and a back wall 154. A slot 156 through which the strap 102 can pass is formed at the bottom of the back wall 154. The back wall 154 is sized such that the inner surface of the back wall (i.e., the distance from the bottom of the top surface 150 to the top of the bottom surface 152 is greater than the width of the block wall, as seen in FIG. 21). Hence, a gap will be formed between the bottom of the block and the top of the retainer bottom surface 152. This gap is sized to allow the strap 102 to pass between the block retainer bottom surface and through the retainer slot 156. The retainer 110' is otherwise used substantially in the same was as the retainer 110, as described above.

After the wall 12 has been constructed, the scaffolding is removed from the wall. As can be appreciated, the straps 102 pass through the wall, and cannot be completely removed from the wall. Rather, the strap is cut off as close as possible to the wall, so that the strap will not be visible. The strap is preferably made from a plastic, to allow for easy cutting of the strap and to provide a strap that will not rust. A metal strap will rust, and the rust will stain the wall 12. The use of a plastic strap 102 will avoid this. Additionally, the retainers 110 and 150 will be positioned on the back side (or earth side) of the wall, and will also stay with the wall.

While the specific embodiments have been described, numerous modifications come to mind without significantly departing from the spirit of the invention, and the scope of protection should only limited by the scope of the accompanying claims. For example, the attachment assembly could be modified to be connected to a positioning projection or key on the wall blocks themselves. In this instance, the strap will not extend through the wall. Rather, the strap will be provided with an opening sized and shaped to be received on the block projection or key. The distance between this block engaging opening and the strap eyelet will be sized such that the bracket standoff 72 (72') will contact the wall. The retainer 82 of FIGS. 13A,B could include a threaded nut which, when threaded onto the threaded end of the rod 78, urges said retainer 82 against the back surface of the retaining wall 12. Although the slots 128 of the retainer 110 are shown to be positioned at the back of the retainer, the slots could be positioned between the front and back ends of the retainer. In this instance, the slots would have to have a length greater than the top of the wedge 140 so as not to interfere with the operation of the wedge. Although the gravity pin 46 is preferred to connect the various brackets to the scaffolding uprights, the brackets could be secured in various other ways as well. For example, spring biased pins, straight pins, etc. could be used in lieu of the gravity pins. These examples are merely illustrative.

The invention claimed is:

1. An attachment assembly for securing an upright of a scaffolding system to a retaining wall comprised of a plurality of retaining wall blocks; the attachment assembly comprising:

a standoff bracket mountable to said upright; said standoff bracket assembly comprising a base adapted to be secured to said upright, a standoff leg extending from said base and an attachment dowel extending from said base; said leg engaging the retaining wall in use to maintain the frame a determined distance from the wall;

a flexible attachment strap having a first end and a second end and being of a length sufficient to pass through said wall; an eyelet in said first end sized and shaped to fit over said standoff assembly attachment dowel; said attachment strap including a slot at its said second end;

a retainer; said retainer comprising a body comprising a top surface, a bottom surface, a block engaging surface adapted to engage said retaining wall during use, and an opening in said block engaging surface; said retainer body opening being sized to allow said attachment strap to pass therethrough; said retainer further including a wedge which is sized and shaped to be received in said attachment strap slot; said wedge having a first side edge which engages a surface of said retainer and a second side edge which engages a surface of said attachment strap slot distal from said retainer surface to urge said retainer against said retaining wall; said retainer cooperating with said attachment strap to pull said stand-off assembly toward said retainer, thereby urging a surface of said retainer and said stand-off against opposite sides of said retaining wall to secure the frame in position relative to the retaining wall.

2. The attachment assembly of claim 1 wherein said retainer body is generally elongate and comprises a back surface spaced from said block engaging surface by said top and bottom surfaces; an opening in said back surface sized to allow said strap to pass therethrough; and aligned slots in said upper and lower surfaces of said retainer; said wedge passing through said slots and engaging a forward surface of said slots.

3. The attachment assembly of claim 2 wherein said retainer body slot forward surfaces are sloped; the slope of the slot surfaces corresponding generally to the slope of the wedge edges.

* * * * *